United States Patent [19]

Abys

[11] 4,424,241

[45] Jan. 3, 1984

[54] ELECTROLESS PALLADIUM PROCESS

[75] Inventor: Joseph A. Abys, Bridgewater, N.J.

[73] Assignee: Bell Telephone Laboratories, Incorporated, Murray Hill, N.J.

[21] Appl. No.: 424,150

[22] Filed: Sep. 27, 1982

[51] Int. Cl.[3] ..... C23C 3/02

[52] U.S. Cl. ..... 427/443.1; 106/1.24; 106/1.28; 427/92; 427/305; 427/437

[58] Field of Search ..... 427/437, 443.1, 305, 427/92; 106/1.24, 1.28

[56] References Cited

U.S. PATENT DOCUMENTS

| | | | |
|---|---|---|---|
| 3,130,072 | 4/1964 | Duva | 106/1.24 |
| 3,274,022 | 9/1966 | Rhoda | 427/437 |
| 3,285,754 | 11/1966 | Hopkin | 427/437 |
| 3,418,143 | 12/1968 | Sergienko | 106/1.28 |
| 3,754,939 | 8/1973 | Pearlstein | 106/1.22 |
| 4,255,194 | 3/1981 | Hough | 427/443.1 |
| 4,279,951 | 7/1981 | Hough | 427/437 |

FOREIGN PATENT DOCUMENTS

| | | | |
|---|---|---|---|
| 2841584 | 4/1980 | Fed. Rep. of Germany | 427/443.1 |
| 52-733 | 1/1977 | Japan | 427/443.1 |
| 1164776 | 9/1969 | United Kingdom | 427/304 |
| 291991 | 8/1971 | U.S.S.R. | 427/304 |

OTHER PUBLICATIONS

Coleman et al., "The $Pd_2Si$-(PD)-Ni Solder Plated Metallization . . . " Conference: 13th IEEE Photovoltaic Specialists Conference-1978, Washington, DC USA (Jun. 5-8 1978).

*Primary Examiner*—John D. Smith

*Attorney, Agent, or Firm*—Walter G. Nilsen

[57] ABSTRACT

A process is described for electrolessly plating palladium metal on a variety of surfaces including palladium surfaces. The process involves use of a special electroless plating bath which is sufficiently stable for practical commercial use and yields excellent plating results. The plating bath contains a palladium salt and organic ligand. A narrow class of reducing agents is used including formaldehyde. The bath is made acid generally by the addition of nitric acid or hydrochloric acid. The process yields plating rates of about 6 microinches per minute and plating thicknesses in excess of 1 micrometer.

13 Claims, 1 Drawing Figure

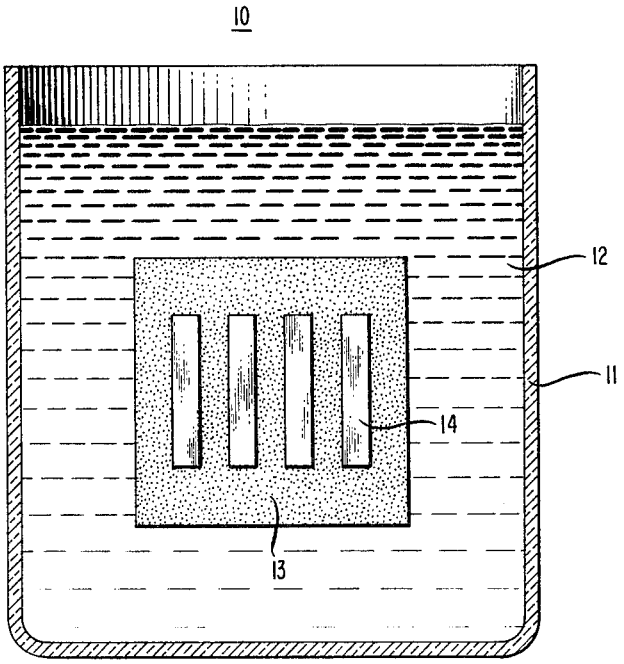
10
12
11
14
13

ELECTROLESS PALLADIUM PROCESS

TECHNICAL FIELD

The invention involves an electroless palladium plating process.

BACKGROUND OF THE INVENTION

There are essentially three methods of producing a layer of palladium on a surface. These methods are the electroplating or electrodeposition method, the vapor deposition method, and the electroless plating method. The electrodeposition method requires elaborate, expensive equipment to ensure deposition at the correct rate and the proper potential. An additional shortcoming of the electrodeposition method is that electric contact must be made to the surface being plated. For highly complex circuit patterns and in particular in integrated circuits where feature density is high, such electric contact is time consuming and difficult to accomplish. In addition, the surface being plated must be electrically conducting and connected to an external source of voltage and current. Vapor deposition also has some inherent disadvantages. In many applications, elaborate high vacuum equipment is required and considerable palladium metal is wasted in the evaporation procedure. There is no convenient way to require the evaporated palladium to adhere only to selected areas on the surface being plated. In other words, pattern delineation with palladium is not easily carried out using the vapor deposition procedure.

Particularly desirable is an electroless plating procedure for palladium in which the palladium plates out on particular surfaces, generally catalytic or sensitized surfaces. Further, it is desirable that such a procedure be carried out using a reasonably stable plating solution. Also, it is desirable that the electroless palladium plating procedure yields plating thicknesses of practical interest particularly where the palladium is used as conducting elements in electrical circuits such as integrated circuits. Often, this means that the electroless plating process should be autocatalytic so that the process continues even after the surface is covered with metallic palladium.

SUMMARY OF THE INVENTION

The invention is a process for electroless plating palladium metal using a unique plating solution. The plating solution contains a source of palladium, optionally an organic ligand, and a narrow class of reducing agents. Suitable reducing agents are formaldehyde, formic acid, hypophosphoric acid and trimethoxyborohydride. The plating solution is made acidic generally by the addition of an acid such as nitric acid or hydrochloric acid. A large variety of organic ligands may be used. These ligands improve the appearance and smoothness of the plated palladium. The organic ligands are generally organic acids such as carboxylic acids, dicarboxylic acids, sulfonic acids, aminosulfonic acids such as 4-aminobenzenesulfonic acids, and sulfonic acid. Additives such as saccharin may be used to improve the properties of the palladium film. The plating process may be carried out at a variety of temperatures from the freezing point of the plating solution to the boiling point of the plating solution. Preferred is the temperature range from 20 to 70 degrees C. with best results obtained near room temperature or slightly higher (20–50 degrees C.) when higher plating rates are desired. A particular advantage of this process is that the palladium will plate out on a variety of catalytic surfaces, including palladium surfaces. For this reason, existing palladium surfaces which are too thin for some applications can be made thicker by this process without masking or making electrical connections to the existing palladium surfaces. In addition to palladium, a large class of elements, alloys and intermetallic compounds are catalytically active including, for example, copper, gold, silver, nickel, and platinum.

Among the alloys of particular interest are permalloy and Kovar which are catalytically active. On some surfaces, an oxide layer is removed to make the surface active. Other materials can be made catalytically active by evaporating or chemically depositing a catalytically active substance on the surface. Rather intricate designs of palladium plating can be made by evaporating a small amount of catalytic metal through a mask and onto a passive surface and then electrolessly plating palladium onto the catalytic metal.

BRIEF DESCRIPTION OF THE DRAWING

The FIGURE shows an electroless plating apparatus useful in the practice of the invention.

DETAILED DESCRIPTION

The invention in broad terms involves the discovery that for electroless plating of palladium, an acid solution of palladium in the presence of certain organic ligands and with a narrow class of reducing agents yields excellent results both in terms of the plating speed and quality and in terms of the stability and shelf-life of the plating solution. The reducing agent should be one or more of the substances selected from the following: formaldehyde, formic acid, hypophosphoric acid and trimethoxyborohydride. Formaldehyde is preferred because of availability and the excellent results obtained. Some reducing agents may be added as salts (sodium or potassium formate, sodium or potassium hypophosphate, etc.) but are converted to the acid form in the acidic plating solution.

An important aspect of the invention is the composition of the electroless plating solution. The plating solution contains a source of palladium, usually added as a palladium salt such as palladium chloride, palladium bromide, palladium nitrate, palladium sulfate, palladium oxide or hydroxide. Concentrations (in terms of palladium metal) may vary over large limits including from about 0.001 to 1.0 molar but generally relatively low concentrations (0.01 to 0.2 molar) are preferred because the solution is more stable and large amounts of palladium are not needlessly kept in the solution.

The electroless plating solution is aqueous and acidic, preferable with pH less than two. More preferably, pH should be less than 1.5 or even 1.0. The solution is made acidic by the addition of an acid agent such as nitric acid, hydrochloric acid, sulfuric acid, etc.

Various additives may be used to improve the performance of the plating process especially as to the quality of the plating. Typical additives are organic ligands selected from a particular class of organic acids. Suitable organic ligands are monocarboxylic acids with up to 10 carbon atoms and dicarboxylic acids with up to 10 carbon atoms. Also useful are sulfonic acids with up to 10 carbon atoms, sulfanilic acid (4-aminobenzenesulfonic acid) and sulfamic acid. The carboxylic acid and dicarboxylic acids may have certain substituents in the carbon chain, namely chlorine, bromine and hydroxyl groups. The sulfonic acid may have in addition to chlorine, bromine and hydroxyl substitution, aromatic substitutions such as benzene ($C_6H_5$—), chlorobenzene, bromobenzene and hydroxybenzene. The limitation on the number of carbon atoms arises to insure sufficient solubility in aqueous solutions to insure effectiveness.

Preferred are certain simple and easily available acids such as oxalic acid, tartaric acid and citric acid. These organic ligands are often added in the form of salts (sodium oxalate, potassium tatarate, etc.) but are converted to the acid in the acidic plating solution.

These organic ligands tend to stabilize the electroless plating solution possibly by complexing with the palladium ion. The presence of the organic ligand in the plating solution greatly improves the quality of the plating with regard to smoothness, brightness, uniformity and adherence. Although the exact mechanism for this behavior is not known, one possibility is that the organic ligand coats the surface to be plated. Other organic ligands may also be useful including organic amines, etc. Concentrations may vary over large limits, including from 0.001 molar to about 1.0 molar. Generally, 0.1 to 0.5 molar yields excellent results.

The reducing agent is crucial to the proper operation of the process. The reducing agent should be strong enough to insure proper reduction of the palladium without being so strong as to induce spontaneous reduction in the absence of the surface to be plated.

It has been found that a select group of reducing agents, namely formaldehyde, formic acid, hypophosphoric acid and trimethoxyborohydride in aqueous medium are suitable as reducing agents for the electroless plating of palladium in acid medium. Preferred is the formaldehyde both from the point of view of availability, low cost, etc., and because of solution stability and the excellent plating results obtained. Concentrations of the reducing agent may vary over large limits, including from about 0.001 to 2.0 molar. Best results are obtained from 0.01 to 1.0 molar. Too low a concentration slows the deposition rate and requires too frequent replenishment of reducing agent; too high a concentration increases the danger of spontaneous deposition. Generally, the reducing agent is replenished so as to keep its concentration range within the limits set forth above. Either bulk replenishment or continuous replenishment is useful in the practice of the invention.

Certain other additives may optionally be added to the electroless plating solution to improve the appearance and properties of the plated palladium. Typical additives are saccharin, cumarin and phenolphthalein. Typical concentrations are 0.001 to 0.1 molar with 0.001 to 0.01 molar preferred. Below 0.001, no effect is likely and above 0.1 molar no additional benefits are found and it might limit the solubility of other components of the bath.

A typical example might serve to illustrate the invention. A solution is made up of 0.1 molar palladium chloride, 0.4 molar formic acid, 1.0 molar nitric acid, 2.0 molar formaldehyde (added as an aqueous solution) and a small amount (about 0.002 molar) of saccharin. The plating is carried out on coupons of brass previously cleaned by first exposing the surface to 20 percent aqueous sulfuric acid, rinsing with deionized water, ultrasonically cleaning in an alkaline cleaner, again cleaning in 20 percent aqueous sulfuric acid and finally rinsing in deionized water. Plating is carried out by exposing the surface of the coupons to the plating solution for a measured amount of time, generally 5 minutes. The plating solution is mildly agitated during plating. The deposits are bright and adherent. Excellent results are also obtained on copper and gold substrates. The plated coupons are sectioned to obtain thickness measurements. The plating rate is about 6 microinches per minute. Plating is also obtained on semiconductor surfaces such as gallium arsenide, indium phosphide and silicon. The gallium arsenide and indium phosphide is cleaned with a one percent bromine in methanol solution. The silicon surface is cleaned using an HF-peroxide solution.

Similar results are obtained with 0.005 molar palladium, 0.2 molar palladium, 0.5 molar HCl and tartaric acid or oxalic acid substituted for formic acid.

The procedure can be used to electrolessly plate palladium on non-catalytic surfaces by activating these surfaces by well-known procedures. For example, an activation solution may be used on the surface covered with catalytic metal by evaporation or other means. Often, (particularly on well-cleaned surfaces), initial deposition might occur by chemical deposition or replacement plating (e.g., where palladium ions in the electroless plating solution reacts with a metal on the surface being plated) and the thin layer of palladium so deposited acts as the catalytic metal for the autocatalytic electroless process described above.

The FIGURE shows an exemplatory plating apparatus 10 useful in the practice of the invention including vessel 11 to contain the plating solution 12, plastic board 13 with strips 14 of catalytic material to be plated electrolessly with palladium.

What is claimed is:

1. A process for electrolessly plating palladium on a catalytically active surface comprising the step of wetting said surface with an electroless palladium plating bath comprising reducing agent characterized in that the electroless palladium plating bath comprises a. source of palladium in the concentration range from 0.001 to 1.0 molar;

b. sufficient acid so the pH of the bath is less than 2, and;

c. reducing agent consisting essentially of at least one compound selected from the group consisting of formaldehyde, formic acid, hypophosphoric acid and trimethoxyborohydride, said reducing agent present in the concentration range from 0.001 to 2.0 molar.

2. The process of claim 1 in which the electroless palladium plating bath additionally comprises organic ligand, said organic ligand consisting essentially of at least one compound selected from the group consisting of monocarboxylic acids with up to 10 carbon atoms, dicarboxylic acids with up to 10 carbon atoms, sulfonic acids with up to 10 carbon atoms, sulfanilic acid and sulfamic acid and the organic has concentration between 0.001 and 1.0 molar.

3. The process of claim 2 in which the organic ligand consists essentially of at least one compound selected from the group consisting of oxalic acid, tartaric acid and citric acid.

4. The process of claim 3 in which the concentration range is from 0.1 to 0.5 molar.

5. The process of claim 1 in which the source of palladium consists essentially of at least one compound selected from the group consisting of palladium chloride, palladium bromide, palladium nitrate, palladium sulfate and palladium hydroxide.

6. The process of claim 5 in which the concentration range of the source of palladium in terms of metallic palladium is between 0.01 and 0.2 molar.

7. The process of claim 1 in which the pH of the electroless palladium plating bath is less than 1.5.

8. The process of claim 7 in which the pH is less than 1.0.

9. The process of claim 1 in which the acid is selected from the group consisting of nitric acid, hydrochloric acid and sulfuric acid.

10. The process of claim 1 in which the reducing agent is formaldehyde.

11. The process of claim 10 in which the concentration of reducing agent is between 0.01 and 1.0 molar.

12. The process of claim 1 in which the electroless palladium plating bath additionally comprises organic additive, said organic additive consisting essentially of at least one compound selected from the group consisting of saccharin, cumarin, and phenolphthalein with concentration between 0.001 and 0.1 molar.

13. The process of claim 12 in which the organic additive consists essentially of saccharin.

* * * * *